US009982502B2

(12) United States Patent
Nelson et al.

(10) Patent No.: US 9,982,502 B2
(45) Date of Patent: May 29, 2018

(54) METAL TO METAL ANNULUS SEAL WITH ENHANCED LOCK-DOWN CAPACITY

(71) Applicant: Dril-Quip, Inc., Houston, TX (US)

(72) Inventors: John E. Nelson, Houston, TX (US); Bruce J. Witwer, Cypress, TX (US); Blake T. DeBerry, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days. days.

(21) Appl. No.: 15/043,913

(22) Filed: Feb. 15, 2016

(65) Prior Publication Data

US 2016/0245040 A1 Aug. 25, 2016

Related U.S. Application Data

(60) Provisional application No. 62/118,365, filed on Feb. 19, 2015.

(51) Int. Cl.

| | |
|---|---|
| ***E21B 33/04*** | (2006.01) |
| ***E21B 33/038*** | (2006.01) |
| ***E21B 33/03*** | (2006.01) |
| *E21B 33/00* | (2006.01) |

(52) U.S. Cl.

CPC ..... *E21B 33/04* (2013.01); *E21B 33/03* (2013.01); *E21B 33/038* (2013.01); *E21B 2033/005* (2013.01)

(58) Field of Classification Search

CPC ..... E21B 33/03; E21B 33/038; E21B 33/04; E21B 2033/005

See application file for complete search history.

(56) References Cited

U.S. PATENT DOCUMENTS 5,174,376 A * 12/1992 Singeetham ..... E21B 33/043 166/182
5,307,879 A * 5/1994 Kent ..... E21B 33/04 166/115
2013/0206427 A1* 8/2013 Reimert ..... E21B 33/04 166/387

* cited by examiner

*Primary Examiner* — D. Andrews
*Assistant Examiner* — Tara E Schimpf
(74) *Attorney, Agent, or Firm* — Baker Botts L.L.P.

(57) ABSTRACT

In accordance with embodiments of the present disclosure, a seal assembly for sealing and locking a casing hanger to a wellhead includes a lower seal body, an upper seal body connected to the lower seal body, an inner lock ring disposed between the upper seal body and the lower seal body, an external lock ring engaging the upper seal body, and an energizing ring. The lower seal body is structured and arranged to form a seal with the casing hanger and the wellhead. The upper seal body includes a load portion that overhangs a load shoulder of the casing hanger. At least a portion of the energizing ring is disposed within an inner groove disposed within the upper seal body. The energizing ring locks the inner lock ring into forcible engagement with the casing hanger, and locks the external lock ring into engagement with the wellhead.

23 Claims, 13 Drawing Sheets

METAL TO METAL ANNULUS SEAL WITH ENHANCED LOCK-DOWN CAPACITY

CROSS REFERENCE TO RELATED APPLICATIONS

The present application is a non-provisional patent application of U.S. provisional application Ser. No. 62/118,365, entitled "Metal to Metal Annulus Seal with Enhanced Lock-down Capacity", filed on Feb. 19, 2015.

BACKGROUND

The present disclosure relates to a hanger system for connecting a casing hanger to a wellhead. More particularly, the present disclosure relates to a seal assembly implemented in conjunction with connecting a casing hanger to a wellhead.

Various types of seal assemblies have been devised for sealing between a casing hanger and a wellhead. Some seal assemblies are suitable for either high temperature or high pressure application, but not both high temperature and high pressure applications. Other seal assemblies are only suitable for modest temperature and pressure applications. Other seal assemblies initially form a seal, but over time lose their sealing effectiveness.

U.S. Pat. No. 7,096,956 discloses a downhole tool for activating a seal assembly, the entirety of which is incorporated herein by reference. In addition, U.S. Pat. No. 6,202,745 discloses a casing hanger positioned within a wellhead, the entirety of which is incorporated herein by reference.

Most downhole wellhead-hanger seal assemblies are manufactured from two or more components which make up the seal body. The seal body supports one or more seals that seal with the wellhead and the casing hanger. In many cases, these components are interconnected by threads, which inherently allow axial travel between components. The axial travel between seal body components results in wear on both the seals and the sealing surfaces. Additionally, high seal setting forces are conventionally difficult to transmit through a seal body with threaded components.

Another significant problem with prior art sealing assemblies is that when fluid pressure is applied from below the set seal assembly, the interior wellhead wall expands radially outward, and the exterior hanger wall contracts radially inward, thereby creating a significant increase in the radial gap, which inherently detracts from sealing effectiveness. The disadvantages of this created gap are particularly significant when high downhole pressure is applied from below the seal assembly.

The disadvantages of the prior art are overcome by the methods and systems disclosed herein which are generally directed to an improved seal assembly and lockdown method of implementing the same.

BRIEF DESCRIPTION OF THE DRAWINGS

Some specific exemplary embodiments of the disclosure may be understood by referring, in part, to the following description and the accompanying drawings.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates to a hanger system for connecting a hanger to a wellhead. More particularly, the present disclosure relates to a lock and seal hanger system for connecting the hanger to the wellhead.

Illustrative embodiments of the present disclosure are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure. To facilitate a better understanding of the present disclosure, the following examples of certain embodiments are given. In no way should the following examples be read to limit, or define, the scope of the disclosure.

The terms "couple" or "couples," as used herein are intended to mean either an indirect or direct connection. Thus, if a first device couples to a second device, that connection may be through a direct connection, or through an indirect electrical connection via other devices and connections. Further, if a first device is "fluidically coupled" to a second device there may be a direct or an indirect flow path between the two devices. The term "uphole" as used herein means along the drillstring or the hole from the distal end towards the surface, and "downhole" as used herein means along the drillstring or the hole from the surface towards the distal end. However, the use of the terms "uphole" and "downhole" is not intended to limit the present disclosure to any particular wellbore configuration as the methods and systems disclosed herein may be used in conjunction with developing vertical wellbores, horizontal wellbore, deviated wellbores or any other desired wellbore configurations.

Figure 1:
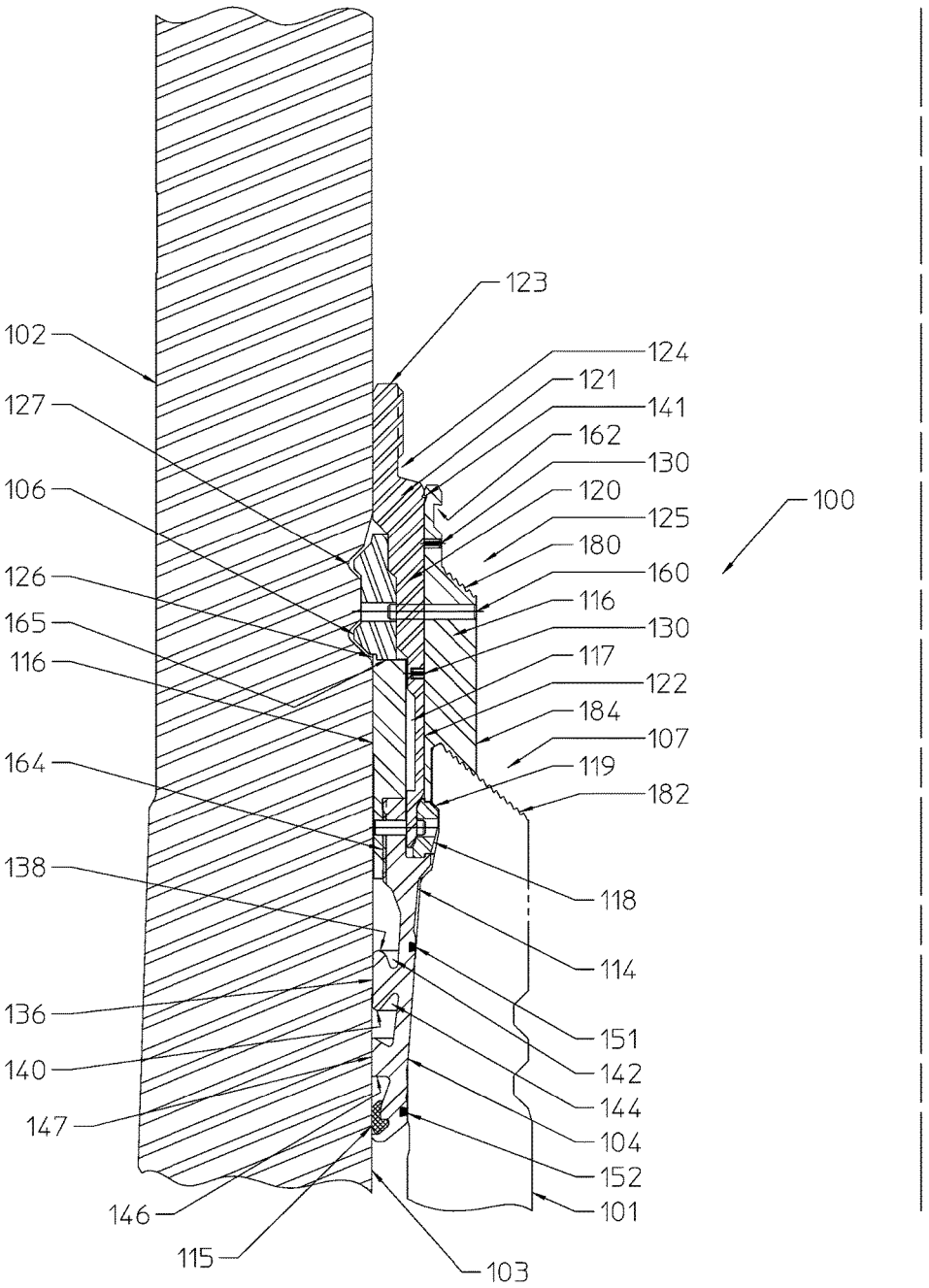
FIG. 1 shows a partial cross-sectional view of a dual lock seal assembly in an actuated configuration engaging a wellhead and a casing hanger, according to certain aspects of the present disclosure.

Referring to FIG. 1, a seal assembly 100 is shown disposed between a wellhead 102 and a casing hanger 101 positioned within the wellhead 102. The wellhead 102 includes an inner generally cylindrical surface 103, while the casing hanger 101 includes a tapered outer surface 104. The seal assembly 100 may seal between the tapered outer surface 104 of the casing hanger and the wellhead inner surface 103. The seal may also seal against a flat outer surface of the casing hanger. Lower seal body 114 is a unitary component positioned between the wellhead 102 and the casing hanger 101. In certain embodiments, the lower seal body 114 may be capable of sealing at least 20,000 psi from above and at least 15,000 psi from below the lower seal body 114. However, the present disclosure is not limited as such and these numbers are provided as illustrative examples only. In certain embodiments, the lower seal body 114 may be a homogeneous component.

The lower seal body 114 may comprise a radially outward projecting member 136, which has annular bumps 138 and 140 at its upper and lower ends for sealing engagement with the wellhead inner surface 103. A gap 142 between a portion of the projecting member 136 and the lower seal body 114 provides for limited outward deflection of the bump 138 at the upper end of member 136 when pressure is applied to the seal assembly from above, while a similar gap 144 allows limited outward deflection of annular bump 140 when fluid pressure is applied to the seal assembly from below. The lower seal body 114 may comprise seals 151 and 152 on the inner surface of the lower seal body 114, each formed from an annular metal bump for sealing engagement with the hanger outer surface 104. In certain embodiments, gaps between the hanger outer surface 104 and the lower seal body 114 may be filled with one or more elastomeric O-rings.

The lower seal 114 may comprise a protector element 146, disposed below the projecting member 136. The protector element 146 may provide a radially outer surface 147 which acts as a protector to eliminate or at least minimize damage to the projecting member 136 when the seal assembly 100 is pushed between the inner surface 103 of the wellhead 102 and the tapered surface 104 of the casing hanger 101, since the outer diameter of protector element 146 is substantially as large as the outer diameter of member 136. Positioned lower than member 136, protector element 146 contacts the interior wall 103 of the wellhead 102 when the seal assembly 100 is pressed in place. The protector element 146 may also serve to prevent crushing of the lower seal body 114 when fluid pressure from above the seal assembly 100 acts to force the lower seal body 114 radially outward. The protector element 146 may act to withstand a high radially outward force on the lower seal body 114 to prevent the sealing surfaces from being crushed so that the seal assembly 100 no longer seals. Even though forces which create a gap and detract from sealing effectiveness are greater when fluid pressure is from below, in certain embodiments, the seal assembly 100 may be able to reliably seal while withstanding a high fluid pressure from both above and below.

The lower seal body 114 may comprise at least one puller mechanism 115 for initially sealing with the wellhead inner surface 103, such that fluid pressure above the puller mechanism 115 pulls the seal assembly 100 downward. The puller mechanism 115 may create an initial seal which allows pressure buildup when a force tool pushes the seal assembly 100 into the set position. Further details regarding a seal puller mechanism are disclosed in U.S. Pat. No. 6,705,615, which is incorporated herein by reference in its entirety.

The lower seal body 114 may support an inner lock ring 118. The inner lock ring 118 may be one unitary piece split ring which locks the lower seal body 114 to the casing hanger 101. The inner lock ring 118 may be disposed between the lower seal body 114 and an upper seal body 116. For example, the lower seal body 114 and the upper seal body 116 may form a pocket that contains the inner lock ring 118.

The upper seal body 116 may comprise a unitary body which provides structural integrity to the seal assembly 100 and is capable of inhibiting bending forces exerted on the seal assembly 100. In certain embodiments, when the upper seal body 116 is actuated as shown in FIG. 1, the seal assembly 100 may maintain the integrity of the seal at extreme axial loads. One non-limiting illustrative example may be an implementation where the seal assembly 100 may withstand an axial load of at least 2 million pounds. Another non-limiting illustrative example may be an implementation where the seal assembly 100 may maintain the seal under an axial load of from 1.5 million to 2 million pounds. In certain embodiments, the upper seal body 116 may comprise a running notch 162 for running and/or retrieving the seal assembly 100, for example using a running tool (not shown).

In certain embodiments, the upper seal body 116 may interlock with the lower seal body 114. For example, a thread 164 may connect the lower seal body 114 to the upper seal body 116. The thread 164 may be located on the lower seal body 114 and configured to engage the upper seal body 116, or the thread 164 may be located on the upper seal body 116 and configured to engage the lower seal body 114. When the upper seal body 116 and the lower seal body 114 are connected (e.g., via the thread connection 164) the two seal bodies 114, 116 create a pocket that contains the inner lock ring 118.

The upper seal body 116 may comprise an annular stop 126 for engagement with a lower portion of an external lock ring 106. In certain embodiments, the annular stop 126 may be disposed on the outer diameter of the upper seal body 116. The external lock ring 106 may comprise a single piece split ring, which may be run in a collapsed state and expanded into lockdown grooves 127 in the wellhead 102, preventing upward movement of the casing hanger 101 and seal assembly 100. The external lock ring 106 may be supported by an external ring load shoulder 165 disposed on the upper seal body 116.

The seal assembly 100 may comprise an energizing ring 120 extending within the upper seal body 116, and engaging the external lock ring 106. The energizing ring 120 may comprise a solid upper ring section 121, which may provide hoop strength that is capable of preventing inward collapse of the energizing ring 120 and/or the seal assembly 100. The energizing ring 120 may comprise a milled lower section 122 that may be inserted into an inner groove 117 of the upper seal body 116.

Figure 2A:
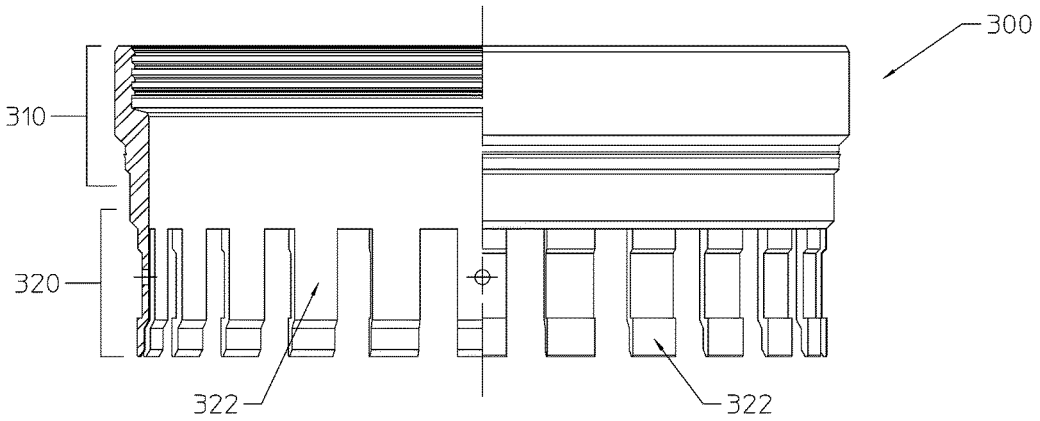
FIG. 2A shows a composite cut-away and side view of an energizing ring, according to certain aspects of the present disclosure.
Figure 2B:
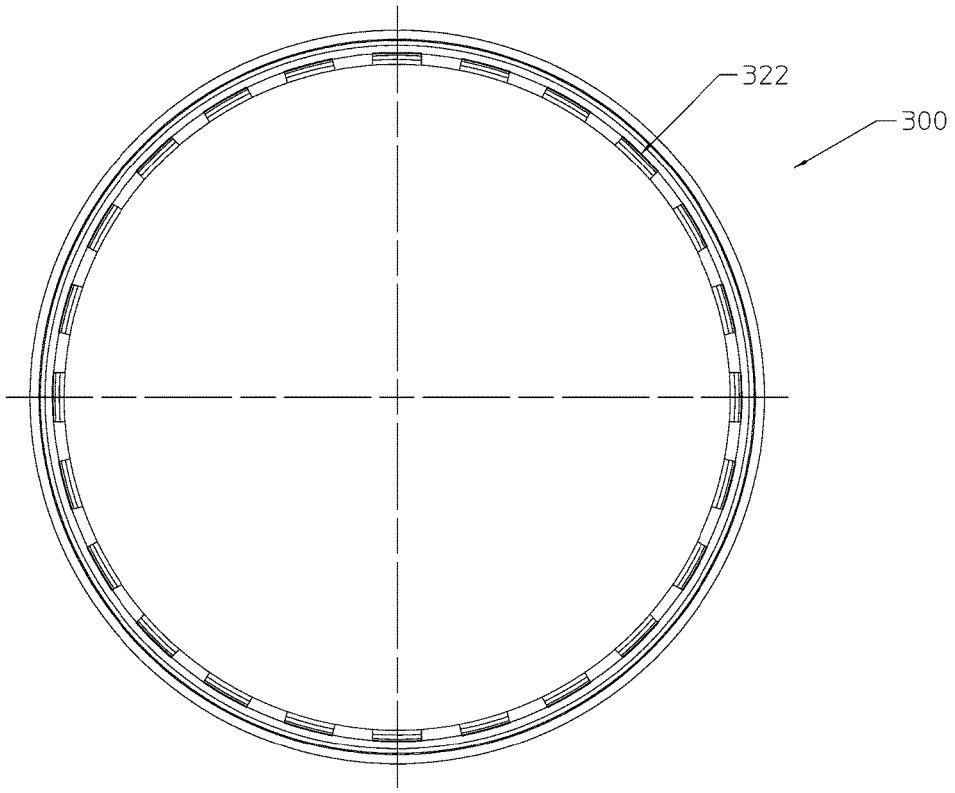
FIG. 2B shows a bottom view of an energizing ring for use in a dual lock seal assembly, according to certain aspects of the present disclosure.

Referring briefly to FIGS. 2A and 2B, an embodiment of an energizing ring 300 is shown comprising a solid upper section 310 and a milled lower section 320. The lower section 320 may comprise a plurality of fingers 322 spaced radially on the energizing ring 300. In certain illustrative embodiments, the energizing ring 300 may comprise 4 to 100 fingers, although the present disclosure is not limited to any particular number of fingers. For example, as shown in FIGS. 2A and 2B, the energizing ring 300 may comprise twenty-four (24) fingers. In certain embodiments, the fingers 322 may be equally spaced on the energizing ring 300.

Figure 3A:
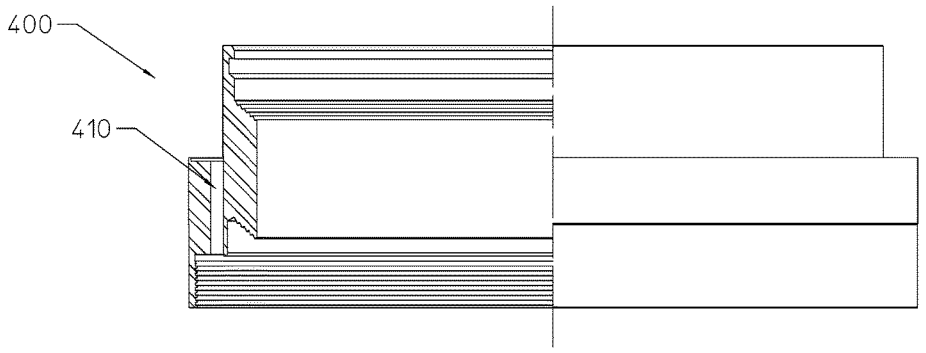
FIG. 3A shows a composite cut-away and side view of an upper seal body for use in a dual lock seal assembly, according to certain aspects of the present disclosure.
Figure 3B:
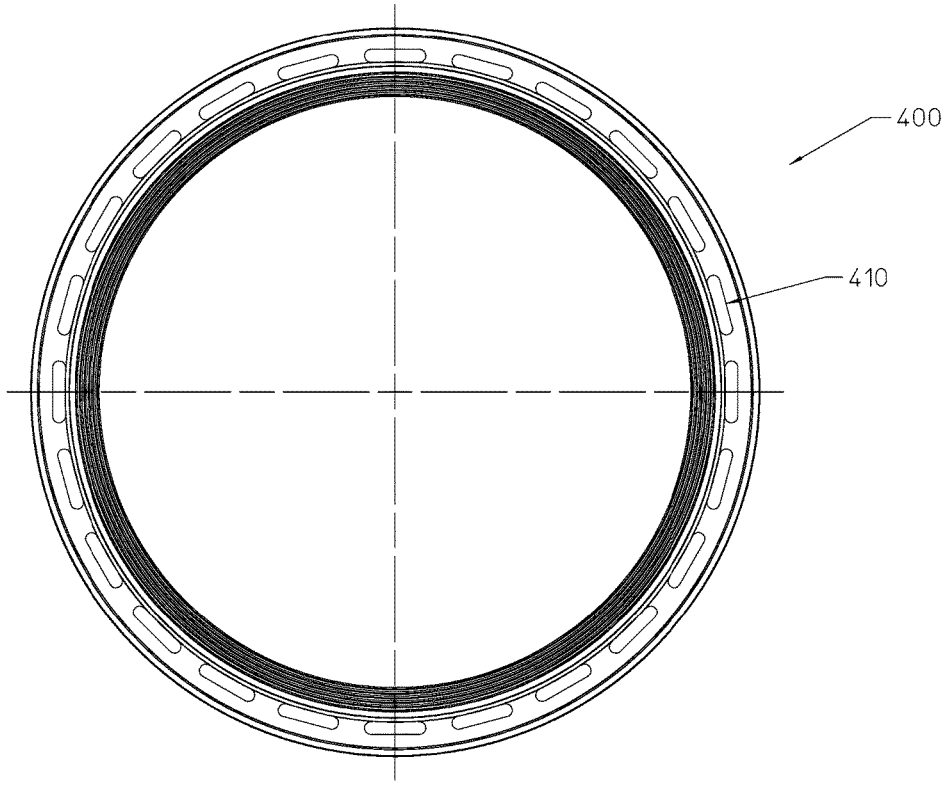
FIG. 3B shows a bottom view of an upper seal body for use in a dual lock seal assembly, according to certain aspects of the present disclosure.

Referring briefly to FIGS. 3A and 3B, an embodiment of the upper seal body 400 is shown comprising a plurality of inner slots 410 spaced radially on the upper seal body 400. In certain illustrative embodiments, the upper seal body 400 may comprise 4 to 100 inner slots 410, although the present disclosure is not limited to any particular number of inner slots 410. Each of the plurality of inner slots 410 may be capable of accepting a corresponding finger of an energizing ring, such as shown in FIGS. 2A and 2B. For example, the number of inner slots 410 may correspond to the number of fingers on the energizing ring. For example, the upper seal body 400 may comprise twenty-four (24) inner slots 410, as shown in FIGS. 3A and 3B, where the energizing ring also comprises 24 fingers.

Figure 4A:
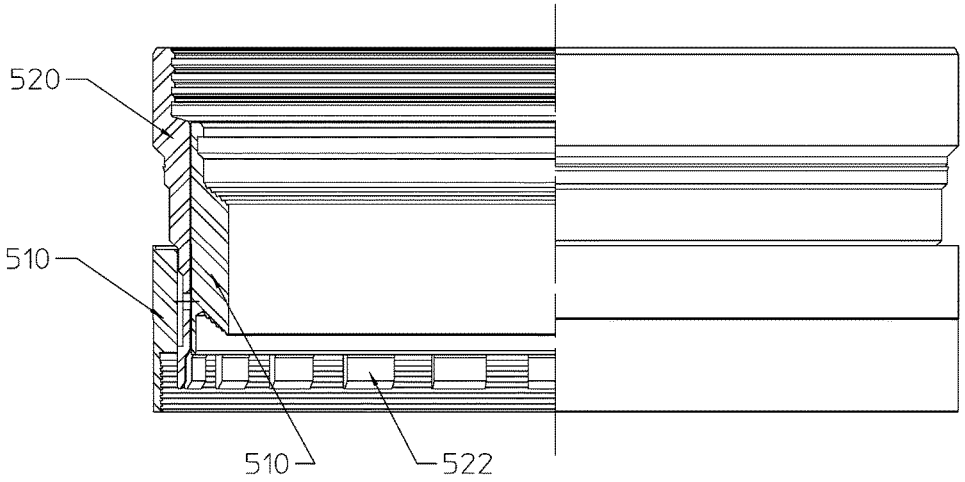
FIG. 4A shows a composite cut-away and side view of an energizing ring and upper seal body assembly for use in a dual lock seal assembly, according to certain aspects of the present disclosure.
Figure 4B:
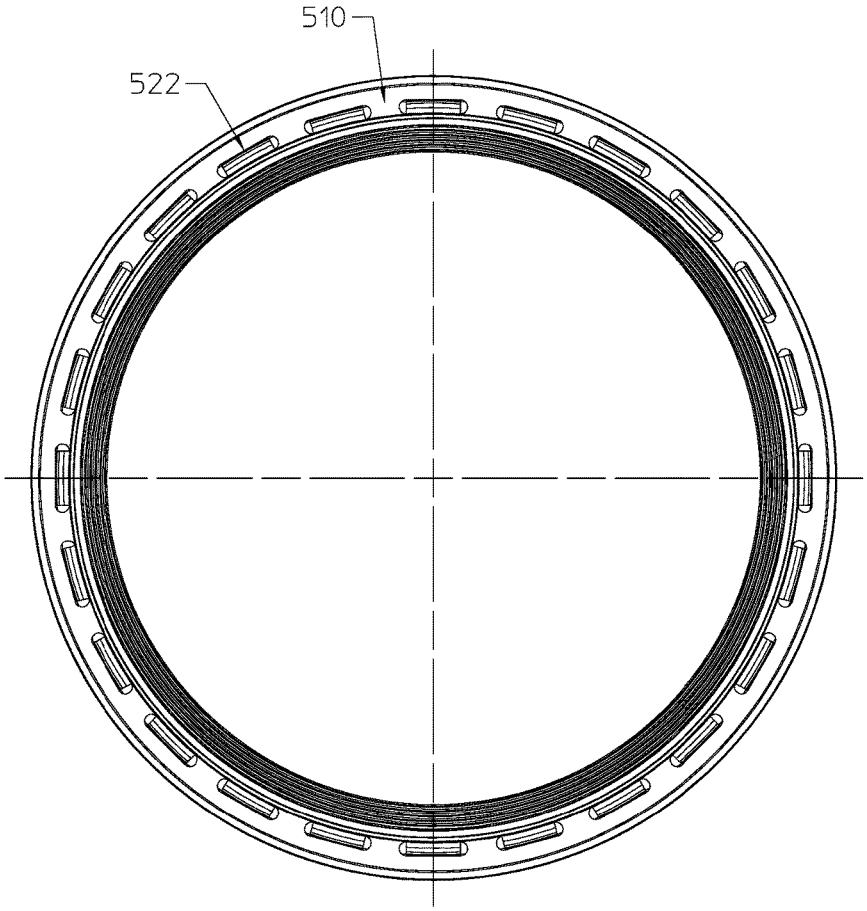
FIG. 4B shows a bottom view of an energizing ring and upper seal body assembly for use in a dual lock seal assembly, according to certain aspects of the present disclosure.

Referring briefly to FIGS. 4A and 4B, an embodiment is shown comprising an upper seal body 510 and an energizing ring 520 inserted and engaging the upper seal body 510 in an actuated configuration. When in the actuated configuration, each of a plurality of fingers 522 may be inserted into a corresponding inner groove of the plurality of inner slots.

Figure 5:
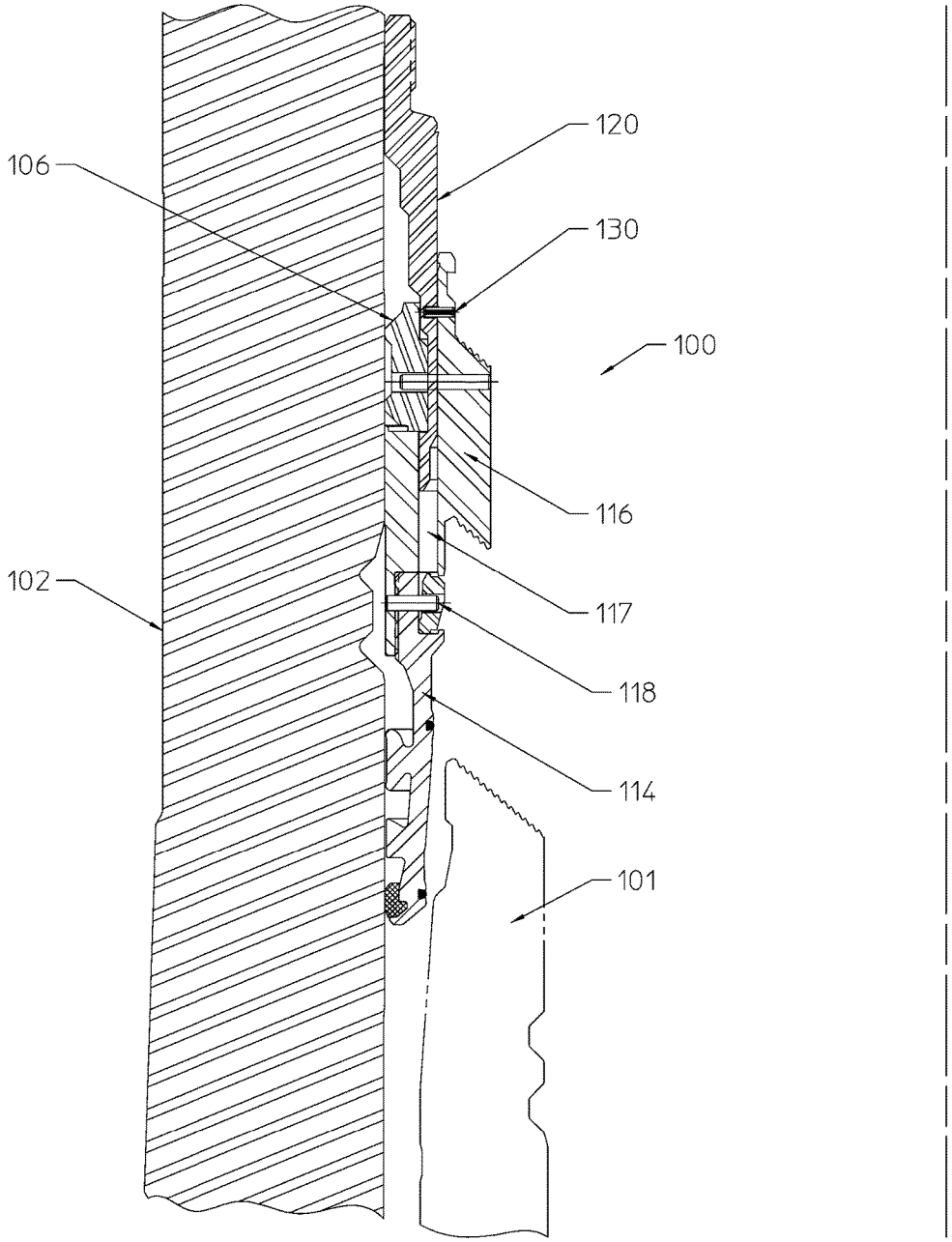
FIG. 5 shows a partial cross-sectional view of a dual lock seal assembly in a non-actuated configuration on approach toward a casing hanger, according to certain aspects of the present disclosure.

Referring to FIG. 5, the dual lock seal assembly 100 of FIG. 1 is shown in a non-actuated configuration while being run toward a casing hanger 101. The seal assembly 100 includes an energizing ring 120 extending into the inner groove 117, but not engaging the inner lock ring 118 and without displacing the external lock ring 106 outward. In certain embodiments, on approach to the casing hanger 101, the seal assembly 100 may comprise one or more shear pins 130 press fit into an upper seal body 116 and through the energizing ring 120 to prevent early deployment of the energizing ring 120 into the upper seal body 116.

Figure 6:
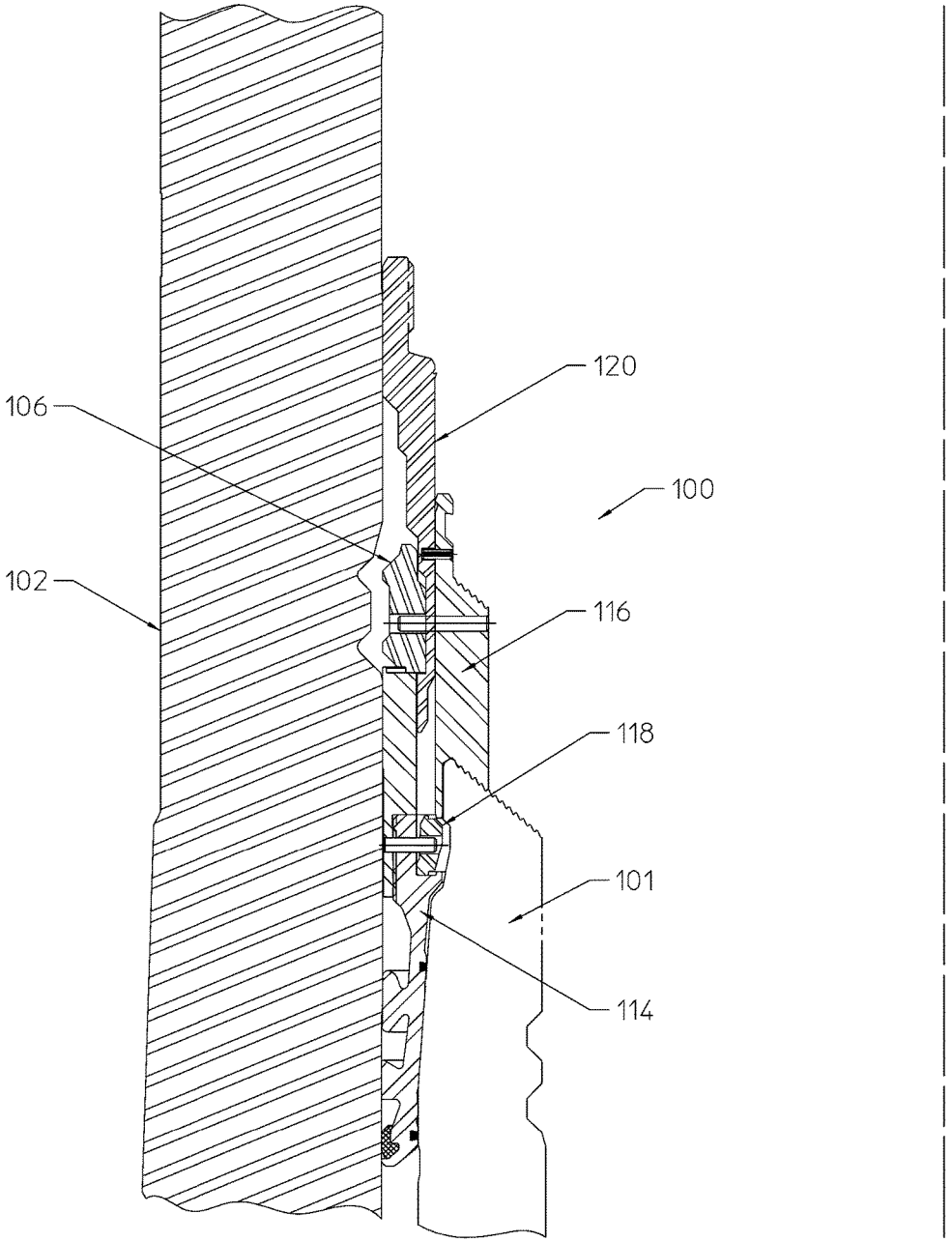
FIG. 6 shows a partial cross-sectional view of the dual lock seal assembly of FIG. 5 in a non-actuated configuration and engaging a casing hanger, according to certain aspects of the present disclosure.

Referring to FIG. 6, the seal assembly 100 is shown engaging the casing hanger 101 and the wellhead 102, while remaining in a non-actuated configuration. In certain embodiments, the seal assembly 100 may remain in the non-actuated configuration while engaging the casing hanger 101 and the wellhead 102 until an operator desires to actuate the seal assembly 100. While in the non-actuated configuration, the lower seal body 114 may form a seal with the casing hanger 101 and wellhead 102, but provides no lockdown.

Referring back to FIG. 1, the seal assembly 100 may be locked into place by actuating the energizing ring 120 downward where the lower section 122 is inserted into the inner groove 117 and engages the inner lock ring 118, as shown in FIG. 1. Once the energizing ring 120 is actuated downward and into the upper seal body 116, the seal assembly 100 may be in an actuated configuration or an energized configuration. In the actuated configuration, the seal assembly 100 may form at least one seal able to withstand well pressure above and below the seal assembly 100 and lockdown the casing hanger 101 to the wellhead 102.

For example, the energizing ring 120 may be actuated using a running and force tool to drive the energizing ring lower section 122 into the inner groove 117. For example, the running and force tool may apply a downward force to an energizing ring setting surface 123. A suitable running and force tool is of the type disclosed in U.S. Pat. No. 7,096,956, which is incorporated herein by reference in its entirety.

When the energizing ring 120 is so actuated, the lower section 122 may engage and press the inner lock ring 118 inward into the casing hanger 101. The inner lock ring 118 may be forced into a recess within the casing hanger 101 and engage a hanger upstop 119, which prevents upward movement of the inner lock ring 118, which may prevent upward movement of the lower seal body 114. Actuating the energizing ring 120 may further force the inner lock ring 118 into the hanger upstop 119 and prevent the inner lock ring 118 from disengaging the casing hanger 101.

When actuated, the upper section 121 may engage and push the external ring 106 into the wellbore lockdown grooves 127. The external ring 106 may engage the lockdown grooves 127 to limit upward and/or downward movement of the seal assembly 100 and casing hanger 101. In certain embodiments, a gap between the walls of the lockdown grooves 127 and the external lock ring 106 may allow some vertical movement of the seal assembly 100 and casing hanger 101 relative to the wellhead 102.

Figure 11:
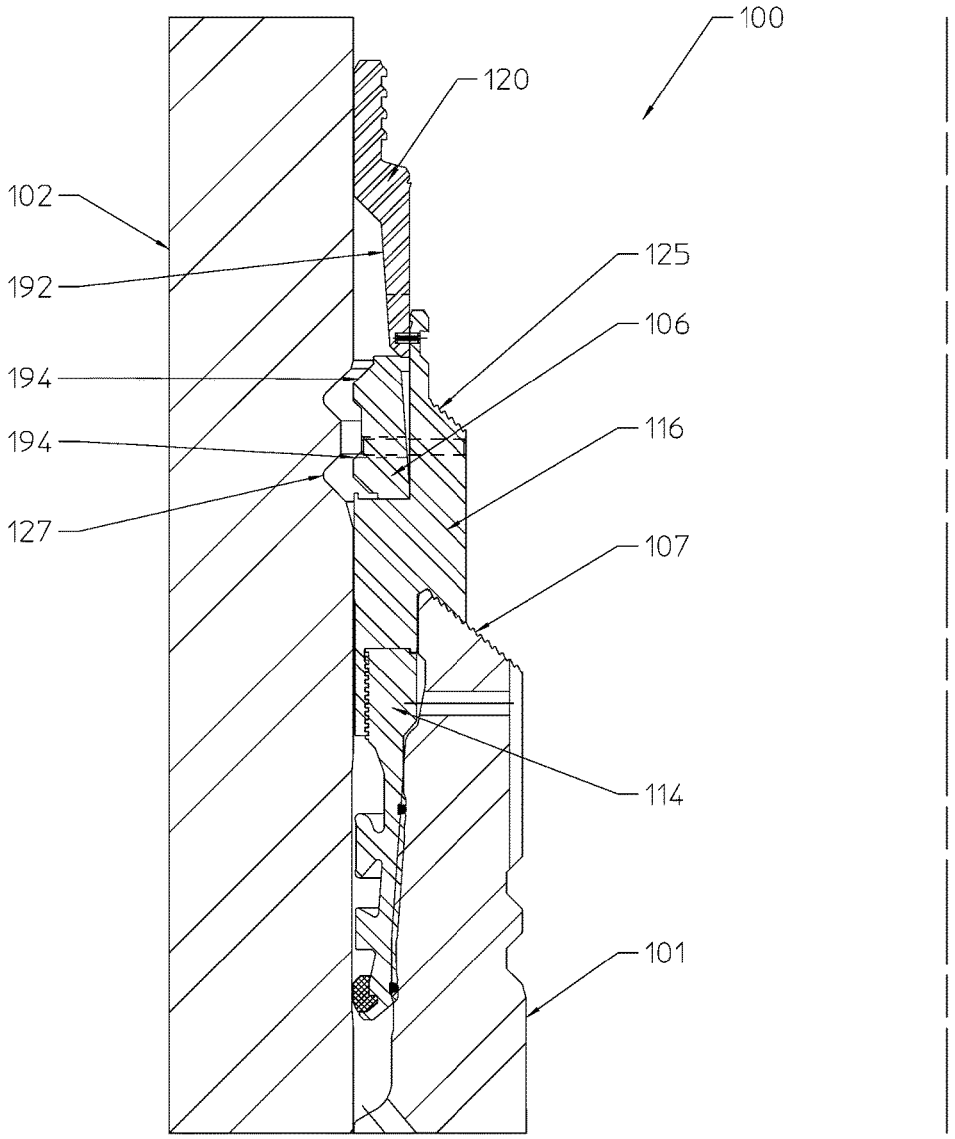
FIG. 11 shows a partial cross-sectional view of a preloading seal assembly in a non-actuated configuration and engaging a casing hanger, according to certain aspects of the present disclosure.
Figure 12:
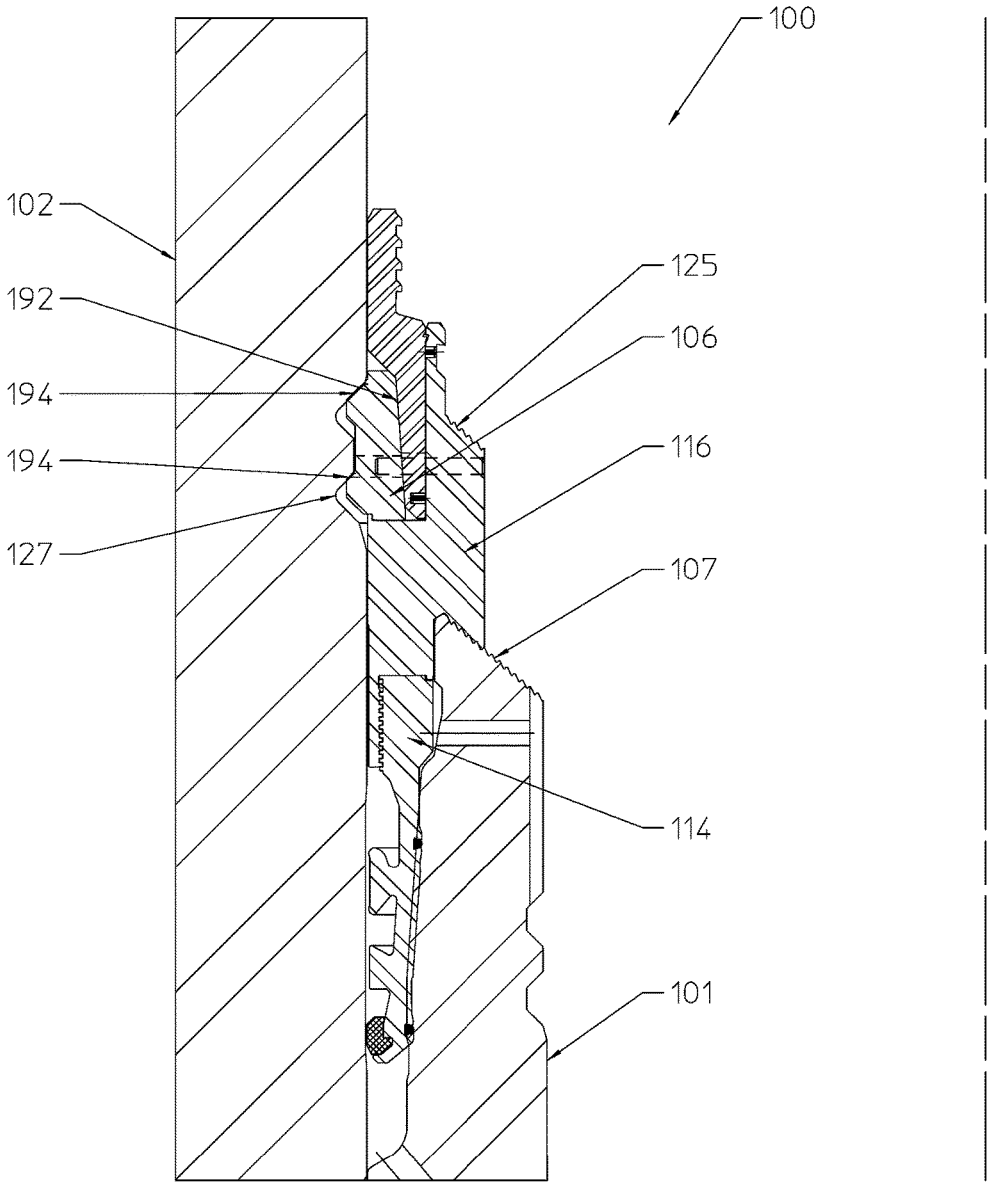
FIG. 12 shows a partial cross-sectional view of the preloading seal assembly of FIG. 11 in an actuated configuration engaging a wellhead and a casing hanger, according to certain aspects of the present disclosure.

In other embodiments, the seal assembly 100 may be preloaded so that no vertical movement of the seal assembly 100 and casing hanger 101 is allowed relative to the wellhead 102. Referring to FIG. 11, one such embodiment of the seal assembly 100 is shown engaging the casing hanger 101 and the wellhead 102, while remaining in a non-actuated configuration. FIG. 12 shows this seal assembly 100 in an actuated configuration or an energized configuration. When actuated, the energizing ring 120 may engage and push the external ring 106 into the wellbore lockdown grooves 127. In this embodiment, the energizing ring 120 may have a tapered surface 192 that pushes outward against the external ring 106 when actuated. The external ring 106 may include two upper facing surfaces 194 designed to engage the corresponding upper tapered surfaces of the lockdown grooves 127. Actuating the energizing ring 120 may preload the seal assembly 100 by forcing the upper facing surfaces 194 of the external ring 106 against the lockdown grooves 127 such that no vertical movement of the seal assembly 100 is allowed relative to the wellhead 102. With this arrangement, the setting surface 125 and the load shoulder 107 may create a preloaded load path capable of supporting a load applied by a second casing hanger disposed in the wellhead 102.

In certain embodiments, actuating the energizing ring 120 into the upper seal body 116 shears the one or more shear pins 130 as the energizing ring 120 moves into the inner groove 117. In certain illustrative embodiments, the seal assembly 100 may comprise four shear pins, although any number of shear pins may be used without departing from the scope of the present disclosure. In certain embodiments, the one or more shear pins may be spaced radially apart from one another around the circumference of the upper seal body 116. For example, where the seal assembly comprises four shear pins, each pin may be spaced 90° from adjacent shear pins.

The seal assembly 100 may comprise a plurality of dowel pins 160, each press fit into the upper seal body 116 and extended through a corresponding radial slot in the external lock ring 106. The dowel pins 160 may be structured and arranged to orient and retain the external lock ring 106 with the upper seal body 116. In certain illustrative embodiments, the seal assembly 100 may comprise at least three dowel pins 160, although any number of dowel pins may be used without departing from the scope of the present disclosure.

Once the energizing ring 120 is actuated into the upper seal body 116, a notch on the energizing ring upper section 121 may move past and engage an overpull feature 141 disposed on the upper seal body 116. The overpull feature 141 may prevent the energizing ring 120 from moving upward relative to the upper seal body 116.

The upper seal body 116 may comprise an overhang portion 184 that overhangs and engages the load shoulder 107. As such, the upper seal body 116 may transfer a downward load to the load shoulder 107. For example, the upper seal body 116 may comprise a setting surface 125. The setting surface 125 may engage a tool and the upper seal body 116 may transfer the load applied to the setting surface 125 onto the casing hanger 101 (e.g., via the load shoulder 107).

Figure 10:
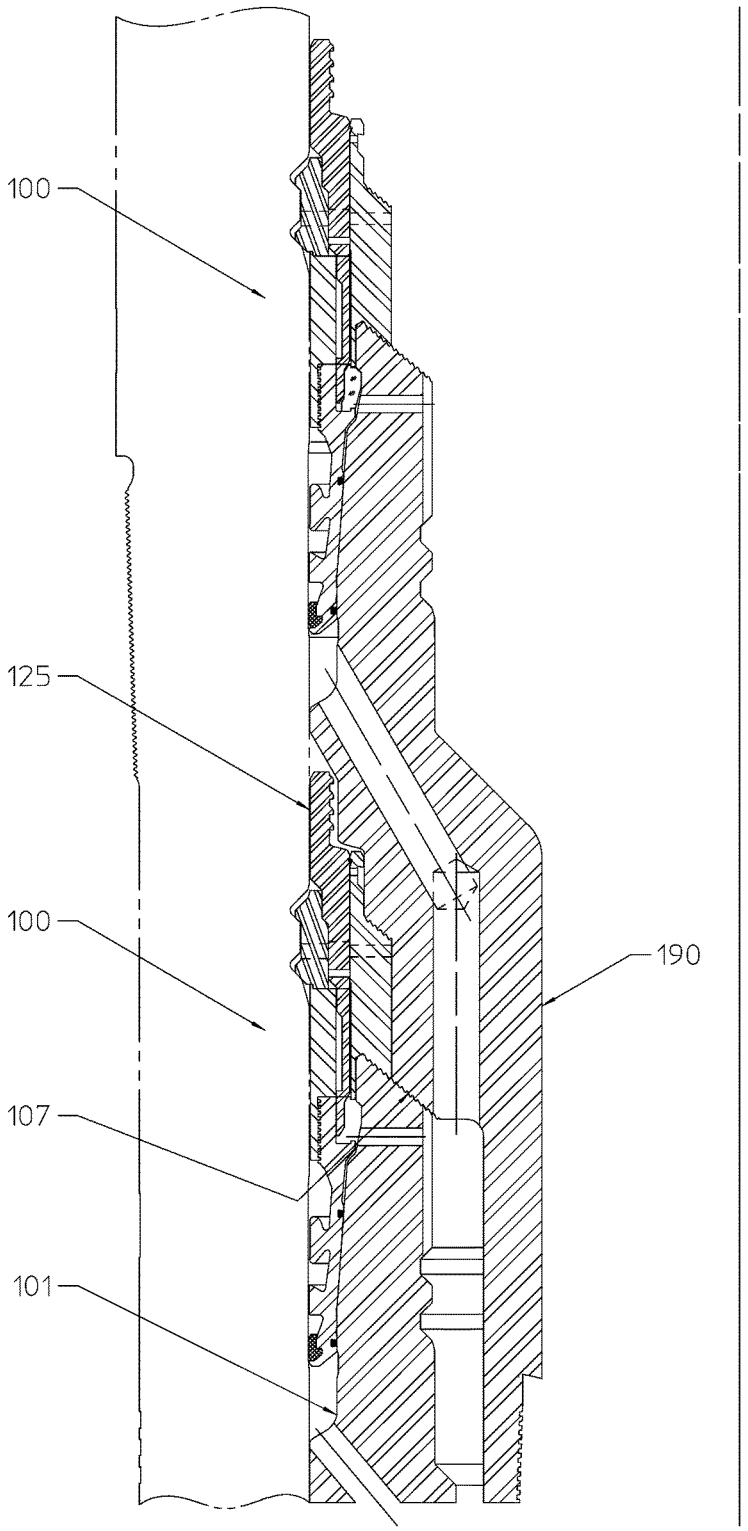
FIG. 10 shows an illustrative system comprising a plurality of seal assemblies sealing and locking a plurality of casing hangers to a wellhead, according to certain aspects of the present disclosure.

Referring briefly to FIG. 10, an illustrative embodiment a system is shown comprising a plurality of seal assemblies 100 sealing and locking a plurality of casing hangers 101, 190 to a wellhead 102, according to certain aspects of the present disclosure. A second position casing hanger 190 may be positioned above a first casing hanger 101 and engage the load shoulder 107 of the first casing hanger 101 and the setting surface 125 of the seal assembly 100. The load shoulder 107 and the setting surface 125 may define a shared load path. In a non-limited embodiment, a plurality of casing hangers 101, 190 may be locked-down to the wellhead 102 using a plurality of seal assemblies 100.

Referring back to FIG. 1, the energizing ring 120 may comprise a setting surface 123, where a load applied to the setting surface 123 may be transferred to the upper seal body 116 and/or the inner lock ring 118 and, in turn, transferred to the casing hanger 101. Thus, the load transferred to the casing hanger 101 may be split between one or more seal assembly setting surfaces 123, 125 and the load shoulder 107. In addition, applying a load across the setting surfaces 123, 125 and the load shoulder 107 may increase hoop stiffness created by the upper seal body 116 and energizing ring 120 assembly.

For example, the setting surface 125 may be disposed on the upper seal body 116 between an inner neck and the inner most diameter of the upper seal body 116. The setting surface 125 may comprise load transfer teeth 180 that complement a tool that engages the setting surface 125 (i.e., female load transfer teeth to engage male load transfer teeth disposed on a tool). For example, the setting surface 125 may comprise female load transfer teeth. The load shoulder 107 on the casing hanger 101 may also comprise complementary load transfer teeth 182, for example, female load transfer teeth. In certain embodiments, the overhang portion 184 of the upper seal body 116 may comprise male load transfer teeth that are structured and arranged to land on and engage the load shoulder 107. As such, the upper seal body 116 may cover and engage with a portion of the load shoulder 107.

Figure 7A:
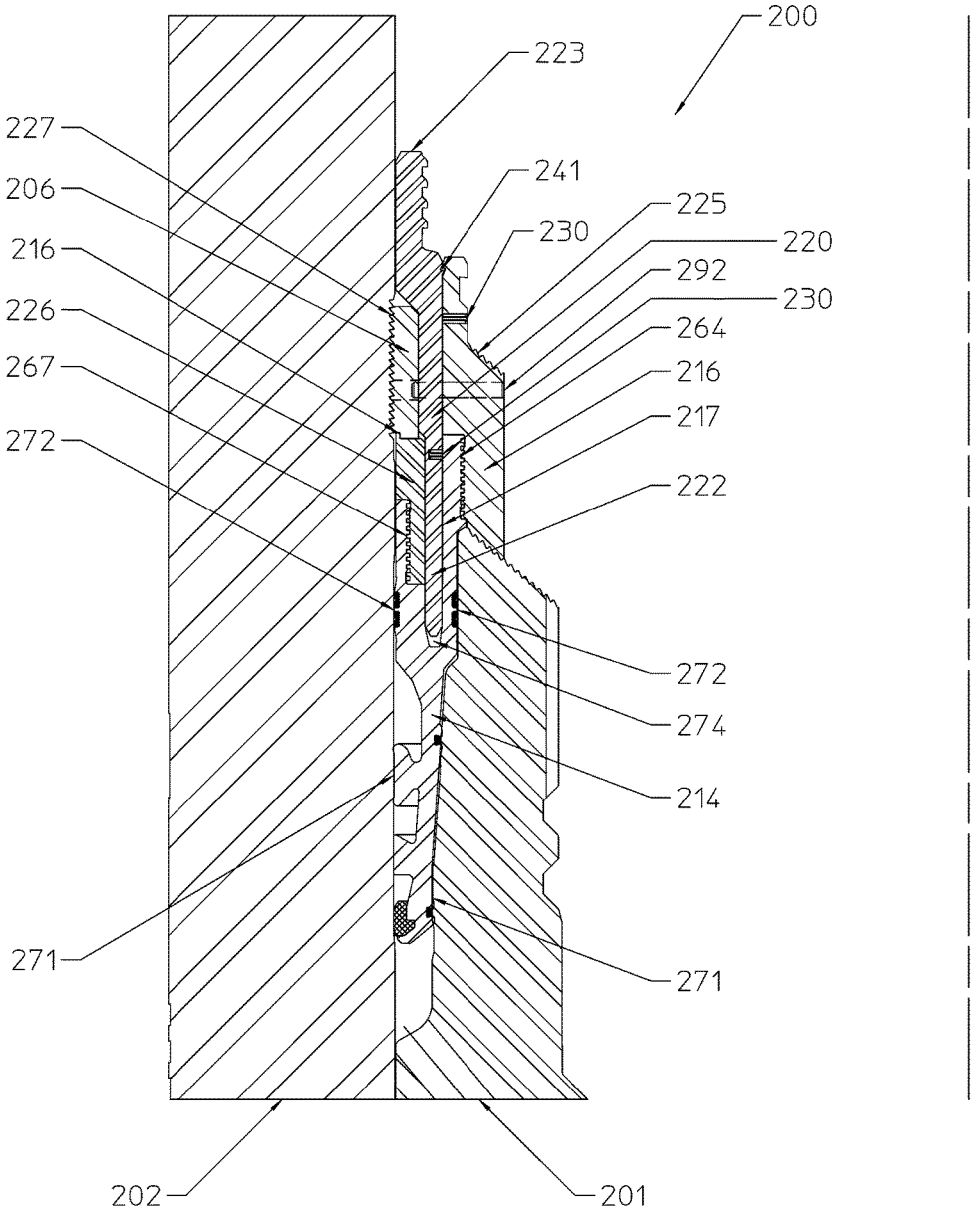
FIG. 7A shows a partial cross-sectional view of a single lock seal assembly in an actuated configuration engaging a wellhead and a casing hanger, according to certain aspects of the present disclosure.

Referring to FIG. 7A, a seal assembly 200 is shown disposed between a wellhead 202 and a casing hanger 201 positioned within the wellhead 202. The seal assembly 200 may comprise a lower seal body 214, which is a unitary component positioned between the wellhead 202 and the casing hanger 201. The lower seal body 214 may comprise a radially outward projecting member, protector element, and/or puller mechanism as described with respect to FIG. 1.

In certain embodiments, the lower seal body 214 may comprise at least one primary seal 271 and at least one secondary seal 272. The primary seal 271 may comprise a metal to metal seal formed between the lower seal body 214 and the casing hanger 201. In certain embodiments, one or more elastomer rings may be disposed on the lower seal body 214 and engage the casing hanger 201. The at least one secondary seal 272 may be disposed on an upper portion of the lower seal body 214 relative to the primary seal 271. The secondary seal 272 may be adjacent to an inner groove 217 disposed within the lower seal body 214. For example, the secondary seal 272 may be disposed near a bottom of the inner groove 217. In certain embodiments, the secondary seal 272 may comprise a metal to metal seal and/or one or more elastomer rings.

The seal assembly 200 may comprise an upper seal body 216, which may comprise a unitary body. In certain embodiments, when the upper seal body 216 is in an actuated configuration, the seal assembly may be capable of maintaining a seal at extreme axial loads.

In certain embodiments, the upper seal body 216 may interlock with the lower seal body 214. For example, a thread connection 264 may connect the lower seal body 214 to the upper seal body 216. For example, the thread connection 264 may comprise complementary thread grooves located on the lower seal body 214 and the upper seal body 216. The lower seal body 214 may interlock with a load ring 218, for example using a thread connection 267. The load ring 218 may provide structural integrity to the seal assembly 200 capable of inhibiting bending forces exerted on the seal assembly 200. The load ring 218 may provide load transfer between the lower seal body 214 and an external lock ring 206, supported by and engaging the load ring 218. The load ring 218 may comprise an annular stop 226 for engagement with a lower portion of the external lock ring 206. The annular stop 226 may be disposed on the outer diameter of the load ring 218. The external lock ring 206 may comprise a single piece split ring, which may be run in a collapsed state and expanded into lockdown grooves 227 in the wellhead 202, preventing upward movement of the casing hanger 201 and seal assembly 200. In certain embodiments, the external lock ring 206 may interlock with the lockdown grooves 227 preventing the seal assembly 200 from moving upward with respect to the wellhead 202.

The seal assembly 200 may comprise an energizing ring 220 extending within the upper seal body 216, and engaging the external lock ring 206. The energizing ring 220 may comprise a solid upper ring section 221, which, when assembled with upper seal body 216, may provide hoop strength to the seal assembly 200 that is capable of preventing inward collapse of the energizing ring 220, external lock ring 206, and/or the seal assembly 200. The energizing ring 220 may comprise a solid lower nose 222 that may be inserted into an inner groove 217 of the upper seal body 216. The energizing ring 220 may comprise a plurality of shear pins 230. As described above, the plurality of shear pins 230 may connect the energizing ring 220 to the upper seal body 216 and prevent further insertion of the energizing ring 220 into the lower seal body 214 until the energizing ring 220 is actuated downward, at which time the shear pins 230 may be broken. The energizing ring 220 may also accept a plurality of dowel pins 292 for orienting the energizing ring 220 with respect to the seal assembly 200, as described above.

Figure 7B:
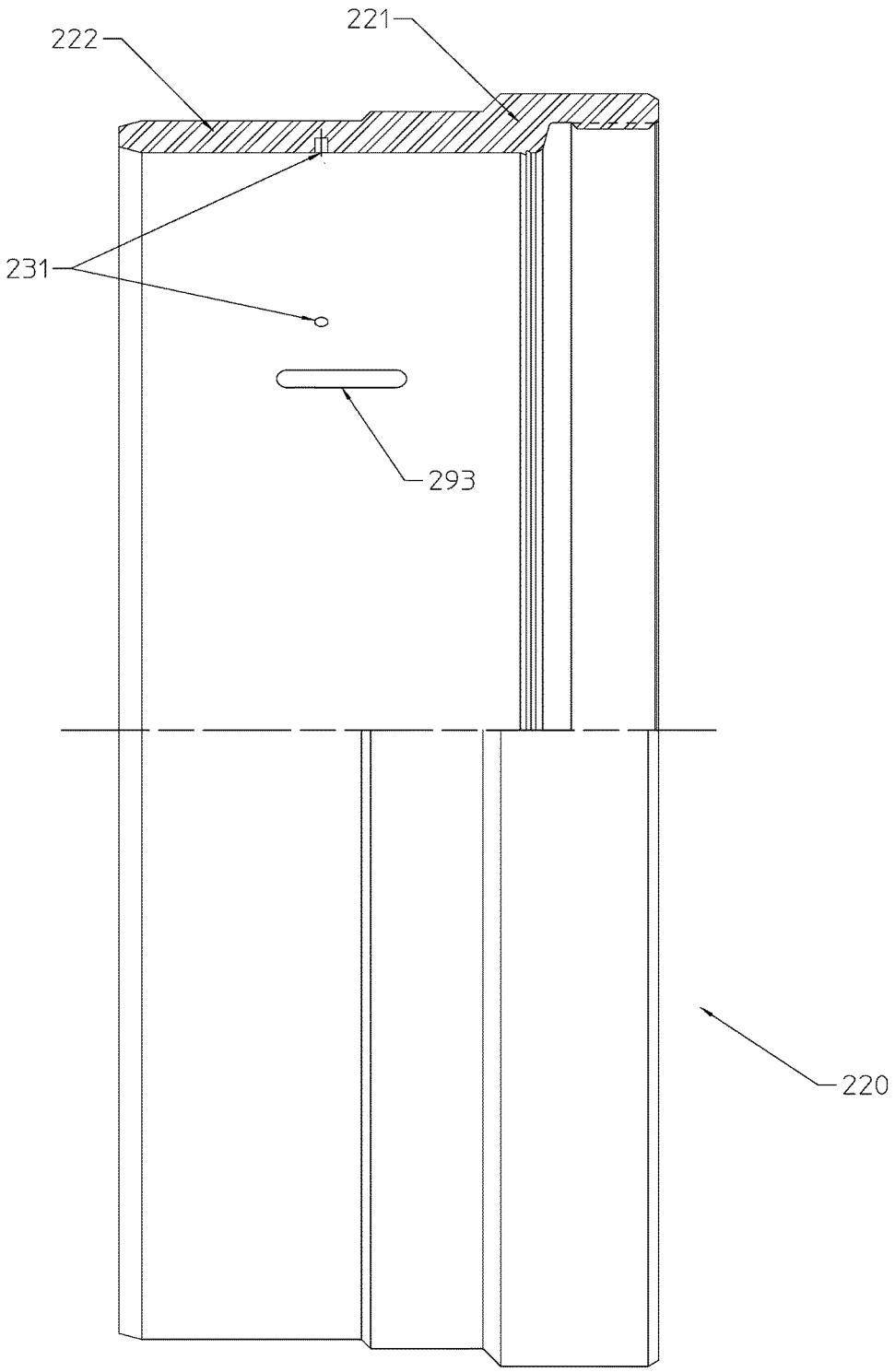
FIG. 7B shows a composite cut-away and side view of an energizing ring used in a single lock seal assembly, according to certain aspects of the present disclosure.

Referring briefly to FIG. 7B, an isolated view of the energizing ring 220 is shown, according to certain embodiments. The lower nose 222 portion of the energizing ring 220 may be a solid ring. The energizing ring 220 is shown comprising a plurality of shear pin slots 231. The energizing ring 220 may comprise a dowel pin slot 293 for accepting one of the plurality of dowel pins to orient the energizing ring 220 with respect to the seal assembly.

Figure 8:
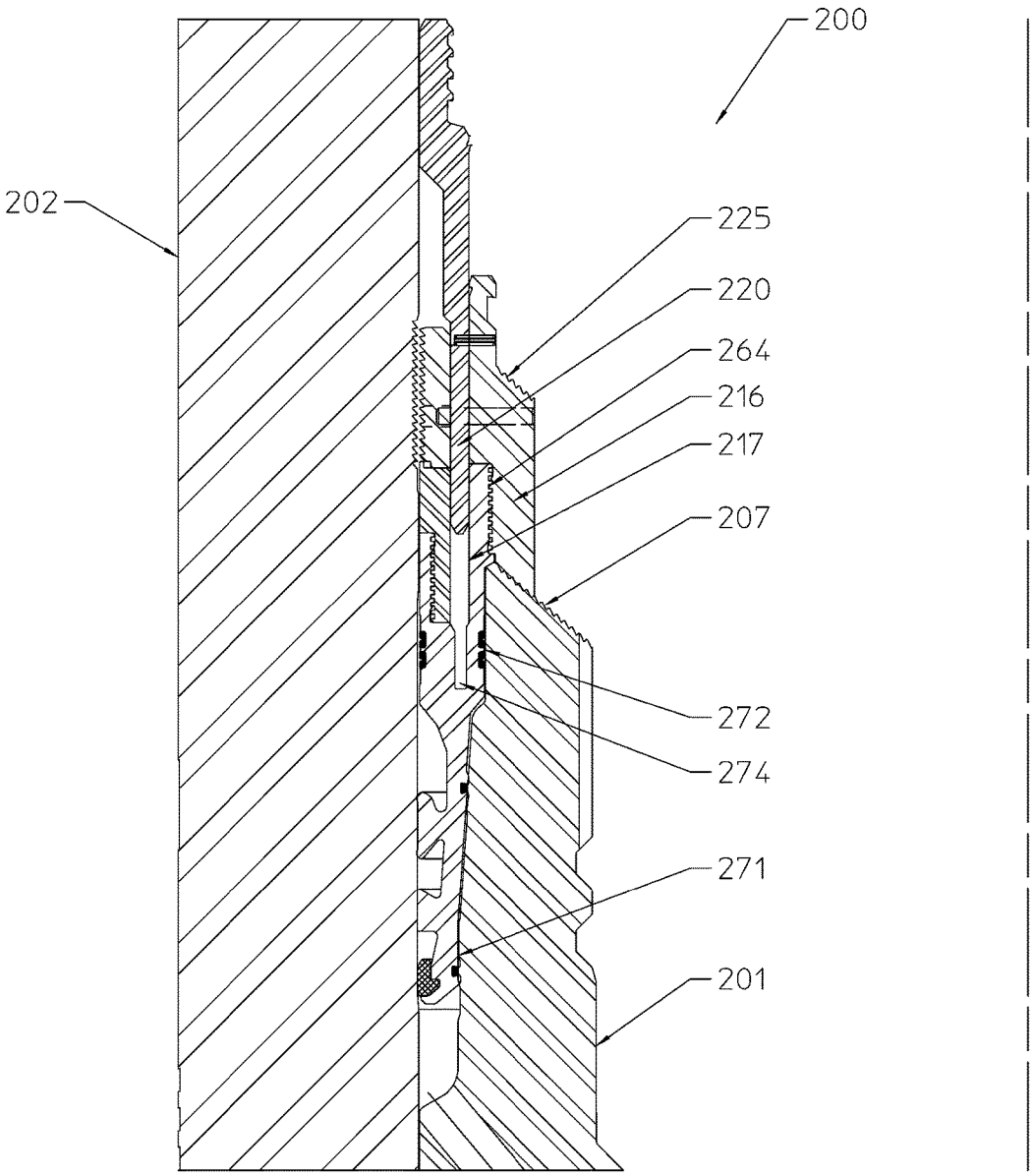
FIG. 8 shows a cross-sectional half view of a single lock seal assembly in a non-actuated configuration and engaging a casing hanger, according to certain aspects of the present disclosure.

Referring to FIG. 8, the seal assembly 200 is shown in a non-actuated configuration, where the upper seal body 216 initially engages a load shoulder 207 of the casing hanger 201. In the non-actuated configuration, the seal assembly 200 has yet to form the primary seal 271 or secondary seal 272 between the wellhead 202 and casing hanger 201. The inner groove 217 may comprise a tapered region 274, having a reduced diameter of less than the lower nose 222 of the energizing ring 220. In the partially actuated configuration, the energizing ring 220 is not extended into the tapered region of the inner groove 217.

Figure 9:
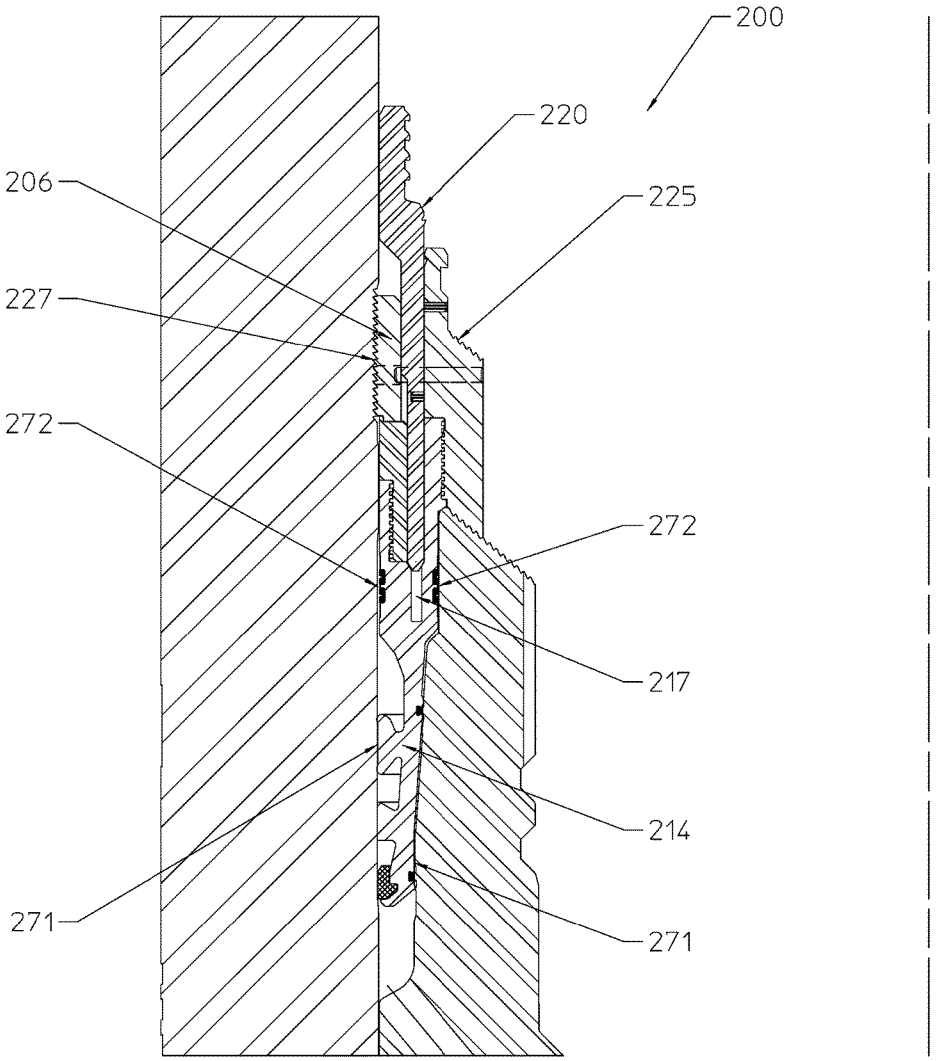
FIG. 9 shows a partial cross-sectional view of the single lock seal assembly of FIG. 8 in a partially-actuated configuration and engaging a wellhead, according to certain aspects of the present disclosure.

Referring to FIG. 9, once the seal assembly 200 reaches the casing hanger 201, the energizing ring 220 may be partially actuated into the inner groove 217 to form the primary seal 271 between the lower seal body 214 and the casing hanger 201. For example, to partially actuate the energizing ring 220 a setting tool may deliver a load to the first setting surface 225, which may force the lower seal body 214 into close engagement between the wellhead 202 and the casing hanger 201 without fully actuating the energizing ring 220. In certain embodiments, the integrity of the primary seal 271 may be tested before the secondary seal 272 is engaged. In this partially actuated configuration, the energizing ring 220 may engage and push the external lock ring 206 into the wellbore lockdown grooves 227. The external lock ring 206 may engage and interlock with the lockdown grooves 227 to limit upward movement of the seal assembly 200.

Referring back to FIG. 7A, the energizing ring 220 may be fully actuated into the inner groove 217, extending the nose 222 of the energizing ring 220 into the tapered region 217. As such, the energizing ring 220 may apply outward pressure to walls of the inner groove 217, which may be transferred to the wellhead 202 and the casing hanger 201 by the lower seal body 214. The outward pressure by the lower seal body 214 against the wellhead 202 and the casing hanger 201 may create the secondary seal 272.

Once the energizing ring 220 is actuated into the upper seal body 216, a notch on the energizing ring 220 may move past and engage an overpull feature 241 disposed on the upper seal body 216. The overpull feature 241 may prevent the energizing ring 220 from moving upward relative to the upper seal body 216.

Accordingly, the seal assembly disclosed herein can be used to form a seal between a wellhead and a casing hanger effective to withstand axial loads exerted by well pressure conditions. As such, the seal assembly may maintain integrity of the seal under a wide range of downhole conditions. In addition, the seal assembly may provide multiple load surfaces for tool engagement while allowing sufficient flow-by area for the seal assembly to be run.

Although a limited number of seal rings are depicted herein, it would be appreciated by those of ordinary skill in the art that seal rings may be utilized at the interface of any two components that are coupled to one another as discussed above without departing from the scope of the present disclosure.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Even though the figures depict embodiments of the present disclosure in a particular orientation, it should be understood by those skilled in the art that embodiments of the present disclosure are well suited for use in a variety of orientations. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning.

What is claimed is:

1. A seal assembly for sealing and locking a casing hanger to a wellhead, comprising:

a lower seal body structured and arranged to form a seal with the casing hanger and the wellhead;

an upper seal body connected to the lower seal body, wherein the upper seal body includes a load portion that overhangs a load shoulder of the casing hanger;

an inner lock ring disposed between the upper seal body and the lower seal body;

an external lock ring engaging the upper seal body;

an energizing ring comprising a lower section that includes a plurality of finger members and an upper section that includes a solid ring, wherein each of the plurality of finger members are disposed within a corresponding inner groove disposed within the upper seal body; and wherein each of the plurality of finger members locks the inner lock ring into forcible engagement with the casing hanger, and locks the external lock ring into engagement with the wellhead.

2. The seal assembly of claim 1, wherein the upper seal body load portion comprises a setting surface, wherein the setting surface and the load shoulder create a load path.

3. The seal assembly of claim 2, wherein the load path created by the setting surface and the load shoulder is capable of supporting a load applied by a second casing hanger disposed in the wellhead.

4. The seal assembly of claim 2, wherein the setting surface and the load shoulder create a preloaded load path capable of supporting a load applied by a second casing hanger disposed in the wellhead.

5. The seal assembly of claim 1, wherein the lower seal body comprises a radially outward projecting member for sealing engagement with the wellhead and a protector element disposed below the projecting member to minimize damage to the projecting member as the seal assembly is pushed between the wellhead and the casing hanger.

6. The seal assembly of claim 1, wherein the lower seal body comprises a puller mechanism for initially sealing with the wellhead so that fluid pressure above the puller mechanism pulls the seal assembly downward.

7. The seal assembly of claim 1, wherein the lower seal body and the upper seal body together create a pocket that contains the inner lock ring.

8. The seal assembly of claim 1, wherein the upper seal body comprises an annular stop for engagement with a lower portion of the external lock ring.

9. The seal assembly of claim 1, further comprising one or more shear pins press fit into the upper seal body and through the energizing ring to prevent early deployment of the energizing ring.

10. The seal assembly of claim 1, further comprising a plurality of dowel pins press fit into the upper seal body and extending through a corresponding radial slot in the external lock ring.

11. The seal assembly of claim 1, wherein the energizing ring comprises a notch for engaging an overpull feature disposed on the upper seal body when the energizing ring is actuated.

12. A seal assembly for sealing and locking a casing hanger to a wellhead, comprising:

a lower seal body structured and arranged to form a primary seal with the casing hanger and the wellhead, wherein the primary seal is formed by a lower portion of the lower seal body extending into sealing contact with both the wellhead and the casing hanger;

a load ring directly connected to the lower seal body, wherein the load ring and the lower seal body form an inner groove including a lower tapered region;

an upper seal body directly connected to the lower seal body, wherein the upper seal body includes a setting surface that overhangs a load shoulder of the casing hanger;

an external lock ring disposed above the load ring and engaging the load ring;

an energizing ring comprising a lower section that includes a nose member and an upper section that includes a solid ring, wherein the nose member is disposed within the inner groove, wherein the energizing ring forces the external lock ring into engagement with the wellhead; and a secondary seal formed via an upper portion of the lower seal body extending into contact with both the wellhead and the casing hanger in response to movement of the energizing ring into the lower tapered region of the inner groove.

13. The seal assembly of claim 12, wherein the upper portion of the lower seal body having the secondary seal is located above the lower portion of the lower seal body having the primary seal, and wherein the secondary seal is disposed near a bottom of the inner groove.

14. The seal assembly of claim 12, wherein the setting surface and the load shoulder create a load path capable of supporting a load applied by a tool or a second casing hanger.

15. The seal assembly of claim 12, wherein the setting surface and the load shoulder create a preloaded load path capable of supporting a load applied by a tool or a second casing hanger.

16. The seal assembly of claim 12, wherein the lower seal body comprises at least one component forming the primary seal, wherein the at least one component is selected from the group consisting of: a radially outward projecting member for sealing engagement with the wellhead, a protector element disposed below the projecting member to minimize damage to the projecting member as the seal assembly is pushed between the wellhead and the casing hanger, and a puller mechanism for initially sealing with the wellhead so that fluid pressure above the puller mechanism pulls the seal assembly downward.

17. The seal assembly of claim 12, wherein the load ring provides a load transfer between the lower seal body and the external lock ring.

18. The seal assembly of claim 12, wherein the load ring comprises an annular stop disposed on an outer diameter of the load ring for engagement with a lower portion of the external lock ring.

19. The seal assembly of claim 12, wherein the secondary seal forms a metal to metal seal.

20. The seal assembly of claim 12, wherein the primary seal is set in response to weight put down on the upper seal body.

21. The seal assembly of claim 12, wherein partial actuation of the energizing ring into the inner groove forces the external lock ring into engagement with the wellhead, and wherein full actuation of the energizing ring into the lower tapered region of the inner groove initiates the secondary seal.

22. The seal assembly of claim 12, wherein the lower portion of the lower seal body is located entirely below the inner tapered region of the inner groove.

23. The seal assembly of claim 12, wherein the secondary seal comprises one or more elastomeric o-rings.

* * * * *